US007149440B2

(12) United States Patent
Arai

(10) Patent No.: US 7,149,440 B2
(45) Date of Patent: Dec. 12, 2006

(54) IMAGE FORMATION APPARATUS AND METHOD FOR DECREASING DENSITY UNEVENNESS

(75) Inventor: Akira Arai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 10/674,809

(22) Filed: Oct. 1, 2003

(65) Prior Publication Data

US 2005/0095015 A1 May 5, 2005

(30) Foreign Application Priority Data

Oct. 1, 2002 (JP) ..... P2002-288378
Oct. 1, 2002 (JP) ..... P2002-288380
Oct. 1, 2002 (JP) ..... P2002-288381
Oct. 1, 2002 (JP) ..... P2002-288382
Oct. 1, 2002 (JP) ..... P2002-288383

(51) Int. Cl.
*G03G 15/00* (2006.01)

(52) U.S. Cl. ..... 399/44; 399/51; 399/53

(58) Field of Classification Search ..... 399/38, 399/42, 44, 51, 53, 222, 223, 227, 50
See application file for complete search history.

(56) References Cited

U.S. PATENT DOCUMENTS 5,307,127 A * 4/1994 Kobayashi et al. ..... 399/103
5,943,530 A * 8/1999 Ozasa ..... 399/129
6,226,481 B1 * 5/2001 Yoneda et al. ..... 399/227
6,909,858 B1 * 6/2005 Hama et al. ..... 399/49

FOREIGN PATENT DOCUMENTS

JP 2004-109980 * 4/2004

* cited by examiner

*Primary Examiner*—Hoan Tran
(74) *Attorney, Agent, or Firm*—Sughrue Mion, PLLC

(57) ABSTRACT

An image formation apparatus includes a development unit using a developer support having a conductive surface layer, and a control unit for causing an idle operation of the developer support to be performed at a predetermined timing in a non-print state.

18 Claims, 5 Drawing Sheets

| | | | | | |
|---|---|---|---|---|---|
| I | II | II | III | III | III |
| I | I | II | III | III | III |
| I | I | II | II | III | III |
| I | I | I | II | II | III |
| I | I | I | I | II | III |

| TEMPERATURE AND HUMIDITY AREA | TONER CONSUMPTION AMOUNT | | |
|---|---|---|---|
| | 0-30% | 30-70% | 70-100% |
| I | a | a | b |
| II | b | b | c |
| III | c | c | d |

| ELAPSED TIME | a | b | c | d |
|---|---|---|---|---|
| 0-1 HOUR | 0 | 0 | 0 | 3 |
| 1-3 HOURS | 0 | 0 | 3 | 6 |
| 3-6 HOURS | 3 | 3 | 6 | 9 |
| 6-12 HOURS | 6 | 9 | 12 | 12 |
| MORE THAN 12 HOURS | 9 | 12 | 15 | 15 |
| AFTER POWER ON | 15 | 15 | 15 | 15 |
| WHEN NEW PRODUCT IS DETECTED | 15 | 15 | 15 | - |

IMAGE FORMATION APPARATUS AND METHOD FOR DECREASING DENSITY UNEVENNESS

The preset application is based on Japanese applications Nos. 2002-288378, 2002-288380, 2002-288381, 2002-288382, and 2002-288383, the entire contents of which are incorporated herein by reference.

BACKGROUND OF THE INVENTION

1. Field of the Invention

This invention relates to an image formation apparatus and an image formation method for decreasing density unevenness appearing on an image in later print if a developer support of an image formation apparatus is left to stand for a predetermined time or more without being rotated.

2. Related Arts

JP-A-2001-56601 describes the following art: In an image formation apparatus in which a development cartridge is placed, if a developer (hereinafter, called toner) stored in the development cartridge becomes unbalanced, to always restore the toner to a proper condition, if the development cartridge is a new product, a new development device startup mode is executed for idling as long as the time required for uniforming the toner and charging the toner; if the development cartridge is not a new product, a toner uniforming mode is executed for idling as long as the time required for uniforming the toner.

If a development roller of an image formation apparatus is left to stand for a predetermined time or more without being rotated and then print is started, density unevenness in the development roller period appears on an image, which will be hereinafter referred to as standing banding. The standing banding is determined by the relative positional relationship of the development roller to a development device with the development roller left to stand. For example, in a development device of a structure wherein a regulating blade is provided below a development roller provided in a development device housing opening opposed to a photosensitive body and a seal is provided above the development roller, when the development roller is left to stand without being rotated, the image density in the portion corresponding to the developing chamber side (in the housing), which will be hereinafter referred to as developing chamber portion, between the lower regulating blade and the upper seal in the development roller circumferential direction becomes high as compared with the portion exposed to the housing outside in the standing state, which will be hereinafter exposure portion, and appears as density unevenness like a band in the development roller period. This standing banding is not an everlasting phenomenon and appears the strongest on the first print sheet just after the standing. The density unevenness becomes inconspicuous every print sheet and as several sheets are printed, the standing banding disappears.

The degree of the standing banding changes depending on the duration of the standing time, the toner degradation degree, and the environmental condition. The longer the standing time, the more conspicuous the banding; the banding becomes noticeable particularly in high-temperature and high-humidity environments.

However, JP-A-2001-56601 proposes that idling is performed as long as the time required for uniforming the toner and charging the toner, but does not give any consideration to the standing banding.

SUMMARY OF THE INVENTION

It is therefore an object of the invention to suppress appearance of standing banding on an image.

According to the invention, there is provided an image formation apparatus including a development unit using a developer support having a conductive surface layer, and a control unit for causing an idle operation of the developer support to be performed at a predetermined timing in a non-print state.

In the invention, the idle operation is a rotation operation of the developer support when a developing bias applied to the developer support is off.

In the invention, the idle operation is a rotation operation of the developer support when an image exposure to an image support is off.

In the invention, the predetermined timing is involved in non-operating time after power on or in non-operating time after the termination of the preceding print.

In the invention, the predetermined timing is applied when installation of a new development device is detected.

In the invention, the idle operation performed in the non-operating time after the termination of the preceding print is performed for the time period determined based on the temperature, the humidity, and the toner consumption amount and the elapsed time since the preceding print.

In the invention, the idle operation performed in the non-operating time after power on or when installation of a new development device is detected is performed for the time period corresponding to the case of high temperature, high humidity, and large elapsed time in the idle operation performed in the non-operating time after the termination of the preceding print.

In the invention, the idle operation performed in the non-operating time after power on or when installation of a new development device is detected is performed for the time period corresponding to the case of high temperature, high humidity, and large elapsed time in the idle operation performed in the non-operating time after the termination of the preceding print.

According to the invention, there is provided an image formation apparatus including a development unit using a developer support having a conductive surface layer, and a control unit for causing an idle operation of the developer support to be performed before image formation operation.

In the invention, the idle operation is a rotation operation of the developer support when a developing bias applied to the developer support is off.

In the invention, the idle operation is a rotation operation of the developer support when an image exposure to an image support is off.

According to the invention, there is provided an image formation apparatus including a rotary developing unit, and a control unit for causing an idle operation of a developer support to be performed each time development units installed in the rotary developing unit are switched.

In the invention, the idle operation is a rotation operation of the developer support when a developing bias applied to the developer support is off.

In the invention, the idle operation is a rotation operation of the developer support when an image exposure to an image support is off.

According to the invention, there is provided an image formation method of opposing a developer support having a developing chamber portion and an exposure portion to an image support and forming an image, the method including the step of performing an idle operation of the developer support to decrease density unevenness caused depending on the standing state of the developing chamber portion and the exposure portion.

In the invention, the idle operation is a rotation operation of the developer support when a developing bias applied to the developer support is off.

In the invention, the idle operation is a rotation operation of the developer support when an image exposure to an image support is off.

In the invention, the idle operation is performed in non-operating time after power on or in non-operating time after the termination of the preceding print.

In the invention, the idle operation is performed when installation of a new development device is detected.

In the invention, the idle operation performed in the non-operating time after the termination of the preceding print is performed for the time period determined based on the temperature, the humidity, and the toner consumption amount and the elapsed time since the preceding print.

In the invention, the idle operation performed in the non-operating time after power on or when installation of a new development device is detected is performed for the time period corresponding to the case of high temperature, high humidity, and large elapsed time in the idle operation performed in the non-operating time after the termination of the preceding print.

According to the invention, there is provided an image formation method including the steps of opposing a developer support having a developing chamber portion and an exposure portion to an image support and forming an image wherein as used toner, the volume fraction of fine powder having particle diameter 5 μm or less is set to 10% or less.

In the invention, the existence ratio of free external additive in external additive added to the toner is set to 8% or less as the number ratio.

In the invention, the wax content is set to 4 wt % or less.

BRIEF DESCRIPTION OF THE DRAWINGS

FIG. 2 is a flowchart to show an idle operation flow when the power is turned on;

DETAILED DESCRIPTION OF THE PREFERRED EMBODIMENTS

Referring now to the accompanying drawings, there is shown a preferred embodiment of the invention.

Figure 1:
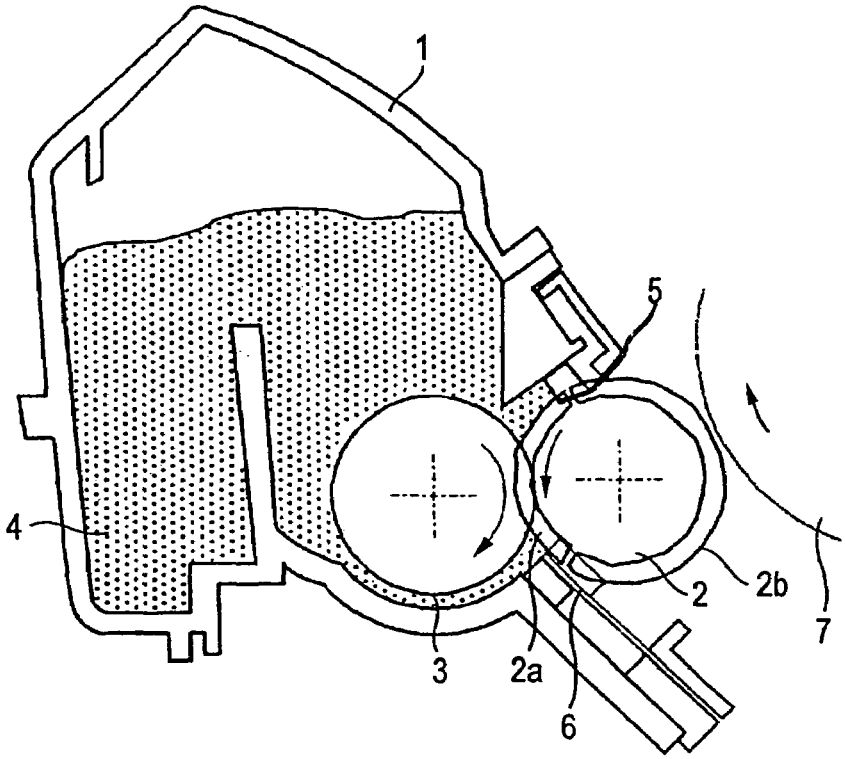
FIG. 1 is a sectional view of the main part of an image formation apparatus used with an embodiment of the invention.

FIG. 1 is a sectional view of the main part of an image formation apparatus used with an embodiment of the invention.

In the embodiment, in a development device for developing an electrostatic latent image formed on a photosensitive body 7 of an image support, a development roller 2 of a developer support is provided in an opening of a housing 1 opposed to the photosensitive body 7 and a supply roller 3 rotating in the same direction (arrow direction in the figure) in the contact part (nip part) with the development roller 2 is provided in the housing 1 for supplying toner 4 stored in the housing 1 to the surface of the development roller 2. A seal member 5 is provided above the development roller 2 and a regulating blade 6 is provided below the development roller 2.

As the supply roller 3 rotates, toner is supplied to the nip part with the development roller 2 and then is transported in a state in which the toner is pressed between both the rollers. The toner is frictionally charged in this process and further is subjected to multi-layer regulation of the regulating blade 6 and is frictionally charged. The toner is transported to the opposed part of the development roller 2 and the photosensitive body 7 and AC jumping developing is conducted. The portion of the development roller 2 positioned in the housing 1 between the seal member 5 and the regulating blade 6 at the print non-operating time is a developing chamber portion 2*a* and the portion exposed to the photosensitive body side is an exposure portion 2*b*.

Next, the mechanism of standing banding occurrence will be discussed. If the toner surface potential on the development roller when the development roller is rotated from the end of standing is measured with a surface potential meter, a peak with low surface potential (absolute value) is observed in the development roller period. At this time, the development roller is grounded. The part where the peak with low surface potential appears corresponds to the developing chamber portion. As the rotation is continued, the peak becomes small and finally the whole becomes uniform surface potential. Likewise, the toner charge amount (μC/g) and transport amount (mg/cm$^2$) on the development roller at the standing banding occurrence time were measured with respect to the corresponding parts of the developing chamber portion and the exposure portion. The developing chamber portion was in high image density and the exposure portion was in low image density. The toner transport amount in the developing chamber portion and that in the exposure portion were almost the same, but the toner charge amount in the exposure portion was almost twice larger than that in the developing chamber portion.

From the result, it can be considered that the surface potential difference between the developing chamber portion and the exposure portion observed just after the rotation start of the development roller from the end of standing is caused by the toner charge mount difference and that the standing banding appears because of the toner charge amount difference on the development roller and the resultant toner flying property difference. As the rotation advances, the toner charge amount is uniformed and the standing banding is also removed. The fact that the charge amount differs depending on the places at the rotation start from the end of standing and then is uniformed indicates that the developing chamber portion and the exposure portion differ in startup of the toner charge amount on the development roller; it is considered that the difference directly causes the standing banding to occur.

The possibility that the state of the top surface of the development roller for frictionally charging the toner is the most effective is high as the cause directly governing the startup of the toner charge amount. Specifically, toner fine powder (toner of small particle diameter) is deposited on the top surface of the development roller and it is considered that the differences of the deposition amount, the water content, etc., from one place to another produce the frictional charge difference between the development roller and the toner and by extension causes the standing banding to occur. When the top surface of the development roller where actual standing banding occurs is seen, it is observed that toner fine powder is deposited on the top surface of the development roller.

The development device used with the image formation apparatus in FIG. 1 adopts a lower regulating technique in which the regulating blade comes below the development roller at the developing time, and the development roller and the supply roller rotate in the same direction in the nip part therebetween, as described above. The developing chamber is separated from the outer space by the regulating blade and the seal member coming in contact with the development roller, and developing is performed in noncontact AC jumping developing technique between the toner held in the exposure portion of the development roller and the photosensitive body. The development device has no agitation member and as described later, when it is held on rotary developing unit and rotary rotation operation is performed, the toner is agitated. The inside of the development device is partitioned by an inner wall formed almost in parallel with the axial direction of the development roller and convection occurs in the toner in the developing chamber in the presence of the inner wall, whereby the agitation effect is promoted and the convection of degraded toner is suppressed. The developing portion is comparatively narrow and the toner is pressed between the development roller and the supply roller at the standing time.

In the surface of the development roller, the image density in the developing chamber portion is high as compared with the image density in the exposure portion and much toner exists in the developing chamber portion and as described above, the toner is pressed between the supply roller and the development roller. In contrast, in the exposure portion, a small amount of toner regulated by the regulating blade exists on the development roller. It is considered that the amount and fixation force of the toner fine powder deposited on the development roller during standing containing the toner external additive differ because of the state difference and cause difference to occur at the startup of charging, resulting in occurrence of standing banding. The standing banding is conspicuous particularly in a half image and is not conspicuous in a solid image because the toner developing amount is sufficient large. If the difference in density between contiguous high-density and low-density portions is 7% or more (0.05 or more if the average of image density value is 0.7) for the average of image density value (about 0.7 in a half image), it becomes a problem level as standing banding. This is the same in the colors of Y, M, C, K.

Then, in the embodiment, the image formation apparatus is provided with a control unit for causing an idle operation of the development roller to be performed for a predetermined time, whereby standing banding is decreased or suppressed, as described later. The idle operation is operation for rotating the development roller in a state in which print is not executed; specifically, it is a rotation operation in a state in which the developing bias applied to the development roller is turned off or image exposure to the photosensitive body is turned off (even if the developing bias is on or supply voltage to the charger for charging the photosensitive body is on), for example. The predetermined time for which the idle operation is performed is the time required for eliminating the image density difference with rotation of the development roller, and the determination method of the predetermined time is described later.

The standing banding appears noticeably particularly when a metal roller is used as the development roller, and also becomes noticeable when ground toner with a comparatively wide particle size distribution and a large fine powder volume fraction is used and titanium oxide powder is used as additional component of the toner and a wax component is contained in the toner to realize oilless fusing. Considering how these factors affect the standing banding, the following mechanism is possible.

A metal roller is conductive and toner fine powder is easily attracted onto the surface of the metal roller by an image force. It is possible that such toner deposition affects the surface of the development roller as a toner charging member. The reason why the development roller exposure portion and the developing chamber portion differ in the startup of charging after standing is as follows: As described above, in the development roller exposure portion, a small amount of toner passing through and regulated by the regulating blade just before standing exists on the development roller: in the developing chamber portion, however, much toner exists between the development roller and the supply roller and the toner is pressed in the nip between the development roller and the supply roller. The developing chamber portion exists in the space sealed by the regulating blade and the seal and thus differs from the exposure portion in both temperature and humidity. Thus, the developing chamber portion and the exposure portion differ in the amount of toner fine powder (containing the additive) deposited on the top surface of the metal exposure, the fixation force, the water content, etc., causing the difference in the startup of the charge amount.

The print speed of the recent image formation apparatus is high as compared with that in a related art. Thus, considering the durability of the development roller and the supply roller, the development roller and the supply roller rotate in the same direction in the nip part therebetween. However, if the rollers rotate in the same direction in the nip part, there is the disadvantage that the resettability (releasability) of toner on the development roller is inferior as compared with the case where the development roller and the supply roller rotate in the opposite directions in the nip part. Since it is considered that the standing banding is mainly caused by deposition of toner fine powder on the surface of the development roller and the state difference as described above, it is considered that such poor resettability of toner as the rollers rotate in the same direction in the nip part weakens the scraping power of the deposited toner fine powder, causing the standing banding to easily appear.

Particularly, to form the metal development roller with a comparatively coarse dimple for multilayer regulation, the disadvantage that the toner at the bottom of the dimple is hard to reset also occurs. Fine powder of titanium oxide is added as an additive to control the charge amount in the toner component and the possibility that the powder is deposited on the top surface of the development roller is also high. Further, a wax component is added to realize oilless fusing. If the wax component exists as fine powder, it is easily deposited on the development roller because of the effect of moisture, etc., and there is also a possibility that it causes difference in the startup of the toner charge amount.

Next, the image formation apparatus for performing the idle operation to suppress the standing banding will be discussed.

In the development device using a development roller formed on a surface with a conductive surface layer, standing banding easily occurs, as described above. The conductive surface layer refers to a layer made of a material having volume resistivity of $1\times10^{2}$ Ωm or less and mainly is made of a conductive substance such as metal or metal oxide, a compound of nitride, or any other graphite.

As such a roller, the following can be named:

A metal sleeve or roller having a surface layer made of metal. It may be a single metal or an alloy and the surface layer material may be different metal from any other metal or an alloy.

A roller formed on a surface layer with a metal layer or any other conductive layer by plating, physical vapor deposition, chemical vapor deposition, contact bonding, thermal spraying, etc.

A roller made of a conductive layer only on a surface layer although the materials other than the surface layer are not metal. For example, a roller with the main material other than a surface layer being rubber and a metal layer provided on the surface layer.

A roller having a surface layer formed of conductive substance dispersed in the surface layer.

If the surface layer is thus conductive, a strong image force caused by charges of fine powder acts as the attractive force between the fine powder made of components forming toner and the roller surface, and the fine powder is strongly deposited on the development roller. Change occurs in the startup of contact charging, frictional charging between the roller and the toner with the fine powder deposited on the roller surface, and it is considered that the developing chamber portion and the exposure portion differ in the deposition state, causing standing banding to occur.

Further, to increase the toner transport amount for enhancing the print speed, for example, abrasive blasting may be applied to the surface of a roller made of metal for forming a dimple to provide face roughness of about several μm, thereby increasing the real surface area of the development roller, as described above. In such a case, the toner at the bottom of the dimple formed by the blasting is hard to reset and thus density unevenness tends to appear. If the development roller and the toner supply roller are rotated in the same direction in the nip part therebetween to speed up, resettability may become poor on the development roller.

Next, one specific example of the development roller in the embodiment is as follows:

Base material: Carbon steel (STKM material)

Abrasive blasting: Dimple formation by abrasive blasting only in image print equivalent part Plating: After abrasive blasting, NiP electroless plating is performed (plating thickness: About 10 μm)

Face roughness: After plating, surface Rz 3–6 μm

Outer diameter; ϕ18 mm

In the image formation apparatus using such a development roller, the idle operation of the development roller is performed for a predetermined time by the control unit, whereby standing banding can be suppressed.

Next, toner capable of suppressing standing banding will be discussed.

The basic components of the toner are as listed in Table 1.

TABLE 1

| Base particles | Polyester-base resin, styrene acrylic etc. |
|---|---|
| Internal additive | Pigment<br>CCA<br>Wax |
| External additive | $SiO_2$<br>$TiO_2$ |

Of the toner components listed above, the components existing as fine powder are largely involved in occurrence of standing banding. As the result of examining the following parameters, it turned out that standing banding can be suppressed as the following range is defined:

Toner fine powder volume fraction having particle diameter 5 μm or less is 10% or less, preferably 5% or less.

The volume fraction of fine powder containing all of toner, free external additive, and wax fine powder having a particle diameter of 5 μm or less is set to 10% or less, preferably 5% or less, whereby standing banding can be suppressed.

Existence ratio of free external additive ($TiO_2$, $SiO_2$) is 8% or less as number ratio.

External additive having a particle diameter of 10 to 100 nm librated from the toner surface deposited on the base particles is deposited on the development roller, causing standing banding to occur. Thus, the existence ratio of free external additive to all external additives (number ratio) is set to 8% or less, whereby it is made possible to suppress occurrence of standing banding.

Wax content is 4 wt % or less

In toner to which wax is added, particularly fine power toner is broken in the wax portion at the grinding time and fine powder of wax occurs. Particularly, in the high-humidity environment, the deposition force of the wax on the development roller is increased by the water crosslinking force and thus occurrence of standing banding becomes more noticeable. Then, the wax content is set to 4 wt % or less, whereby occurrence of wax fine powder is lessened and thus the amount of wax deposited on the surface of the development roller at the standing time lessens and standing banding is suppressed.

Specific examples of the toner components are listed in Table 2.

TABLE 2

| | Y | C | M | K |
|---|---|---|---|---|
| Average particle diameter (μm) | 8.8 | 8.7 | 9.0 | 8.7 |
| Fine powder volume fraction 5 μm or less (%) | 2.1 | 1.2 | 0.9 | 1.4 |
| Wax addition amount (wt %) | 1.8 | 2.3 | 3.2 | 2.8 |
| Free external additive number ratio (%) | 5.5 | 4.8 | 6.2 | 6.8 |

The average particle diameter and the fine powder volume fraction are the values found by measurement using a multiple sizer and the free external additive number ratio is the values found by measurement using PT-1000. Standing banding can be suppressed using the toner.

Next, the timing at which the idle operation is performed will be discussed.

Figure 2:
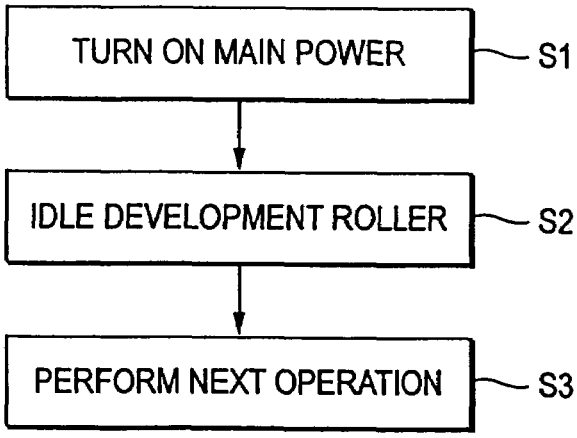

FIG. 2 is a flowchart to show an idle operation flow when the power is turned on.

When the power is turned on, what state the development device installed at the point in time has been left to stand in is unknown and thus the idle operation is performed. That is, when the main power is turned on (step S1), the development roller is idled (step S2) and then the next operation is performed (step S3).

Thus, banding occurring when the power is turned on at which the standing state is unknown can be suppressed.

Figure 3:
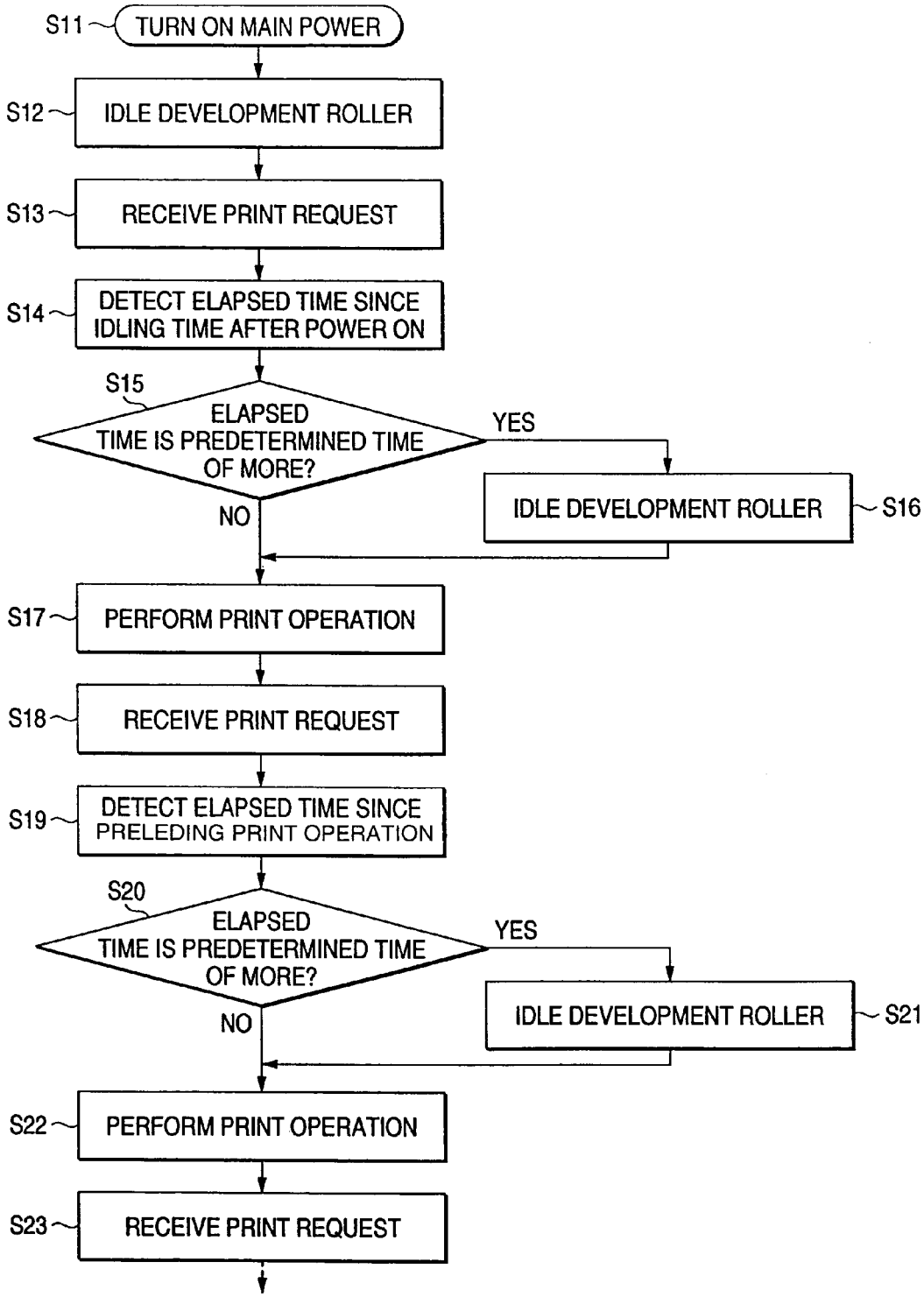
FIG. 3 is a flowchart to show an idle operation flow when the elapsed time since the termination time of the idle operation after the power is turned on or the final print termination time becomes a predetermined time or more.

FIG. 3 is a flowchart to show an idle operation flow when the elapsed time since the termination time of the idle operation after the power is turned on or the final print termination time becomes a predetermined time or more.

When a print request comes after idling is performed after the power is turned on as shown in FIG. 2, the elapsed time since the termination time of the idling after the power is turned on or the final print termination time is detected and if the elapsed time becomes a predetermined time or more, the idle operation is performed. To do this, the image formation apparatus must have a timer.

When the main power is turned on (step S11), the development roller is idled (step S12). Next, when a print request comes (step S13), the elapsed time since the idling time after the power was turned on is detected (step S14), and whether or not the elapsed time is a predetermined time or more is determined (step S15). If the elapsed time is the predetermined time or more, the development roller is idled (step S16). If the elapsed time does not reach the predetermined time or after the idling terminates, the print operation is performed (step S17). Next, when a print request comes (step S18), the elapsed time since the preceding print operation time is detected (step S19), and whether or not the elapsed time is a predetermined time or more is determined (step S20). If the elapsed time is the predetermined time or more, the development roller is idled (step S21). If the elapsed time does not reach the predetermined time or after the idling terminates, the print operation is performed (step S22). When another print request comes, similar processing is repeated.

Figures 4, 5, 6:
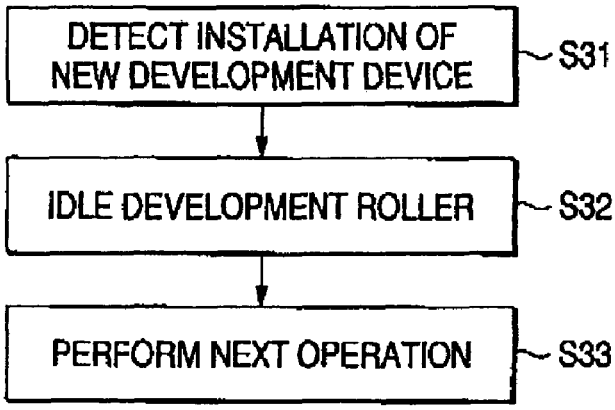
FIG. 4 is a flowchart to describe an idle operation flow when installation of a new development device is detected.
FIG. 5 is a drawing to describe area setting on a temperature-humidity map.
FIG. 6 is a drawing to describe the relationship of the elapsed time since the termination time.

FIG. 4 is a flowchart to describe an idle operation flow when a new development device is detected.

When a new development device is installed, it is possible that basically the new product has been left to stand for a comparatively long time and thus sufficient idling is performed. That is, when installation of a new development device is detected (step S31), a development roller is idled (step S32) and the next operation is performed (step S33).

Next, a determination method of the development roller rotation time at the idling time will be discussed.

The occurrence situation of standing banding changes depending on the environments (temperature and humidity), the degradation degree of toner (consumption amount), etc., as described above. Then, the idling time of the development roller is determined according to the following method:

Area determination on temperature-humidity map

As shown in FIG. 5, several areas (I to III) are preset on a temperature and humidity map. In FIG. 5, the horizontal axis indicates temperature and the vertical axis indicates humidity; in the example, the map area is divided like a matrix with the temperature in five-degree steps from 10° C. to 40° C. and the humidity in 5% steps from 15% to 90%, and mostly low-temperature area is I, high-temperature area is III, and intermediate area of both temperature and humidity is II. When a print request is received, the temperature and humidity are detected by sensors installed in the image formation apparatus and an area in FIG. 5 is selected.

Matrix of temperature-humidity map area and toner consumption amount

A matrix as shown in FIG. 6 is created about the areas in the matrix of the temperature-humidity map shown in FIG. 5 and the toner consumption amount, and arguments (a, b, c, and d in FIG. 6) are preset. As the toner consumption amounts are 0%–30%, 30%–70%, and 70%–100% for the temperature-humidity areas I, II, and III in FIG. 5, the arguments a, b, and C are set. When a print request is received, the toner consumption amount (found from the print duty and the number of print sheets) is detected and one of the arguments in FIG. 6 is selected.

Matrix of arguments and elapsed time

Figures 7, 8:
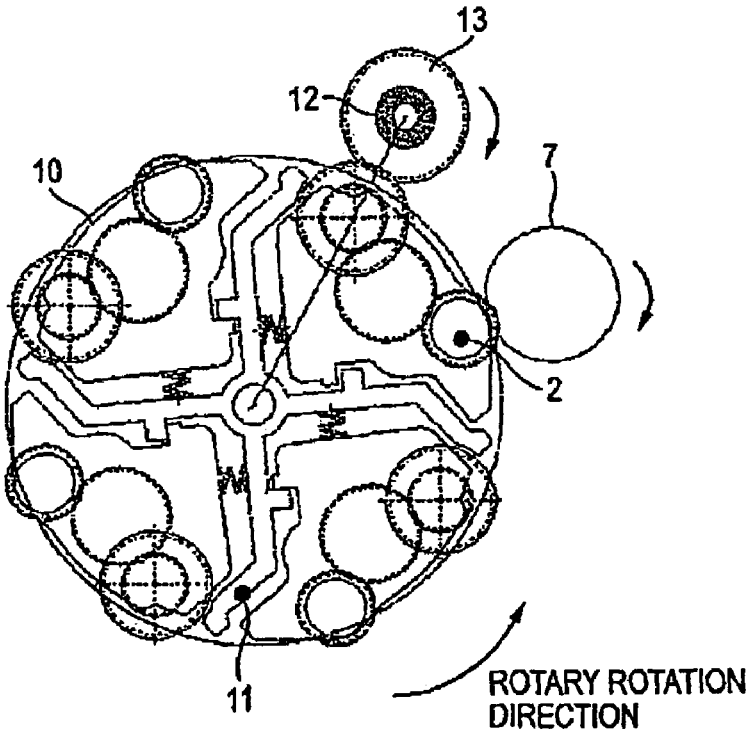
FIG. 7 is a drawing to show a matrix for determining the idling time of a development roller.
FIG. 8 is a drawing to describe a rotary developing device.

A matrix to determine the idling time of the development roller as shown in FIG. 7 is set from the relationship between the arguments in the matrix in FIG. 6 and the elapsed time since the termination time of the idling after the power is turned on or the final print termination time.

In FIG. 7, the values of the arguments a, b, c, and d in FIG. 6 are determined as the idling time for each of the elapsed time 0–1 hour, 1–3 hours, 3–6 hours, 6–12 hours, 12 hours or more, and the detection time of a new product after the power is turned on. Here, the argument units are seconds and 0 seconds mean that the idle operation is not performed. When a print request is received, the elapsed time is detected by the timer and the required idling time is determined from the matrix in FIG. 7 and then the idling operation is started. The idling operation thus determined is performed at each timing, whereby standing banding can be prevented from occurring. In FIG. 7, for the idling after the power is turned on and the idling when a new development device is detected, the previous state is unknown and therefore the arguments are set to large values.

Next, an example wherein the idle operation of the development roller is performed each time the switching operation of a rotary developing device is performed.

FIG. 8 is a drawing to describe the rotary developing device.

A rotary frame 11 made of a rack retention member has four rooms and can accommodate Y, M, C, and K color development cartridges in the four rooms. The rotary frame 11 is at the home position at the stop time and rotates in one direction indicated by the arrow by a one-way clutch 12 having a drive output gear 13 for bringing development rollers 2 corresponding to the colors into the developing position opposed to a photosensitive body 7 in order.

Such a rotary developing device needs only one developing position as compared with the case where four color development devices are placed in parallel with photosensitive bodies, for example, and it is made possible to miniaturize an image formation apparatus. The rotary developing device rotates for bringing each color development device into the developing position. When the rotary developing device rotates, the toner existing in the development device is agitated. As the toner is agitated, if the development device containing no agitation member is used (the image formation apparatus in FIG. 1), residence of the toner is prevented and startup of toner charging is promoted.

Next, the idle operation in the rotary developing device will be discussed.

Figure 9:
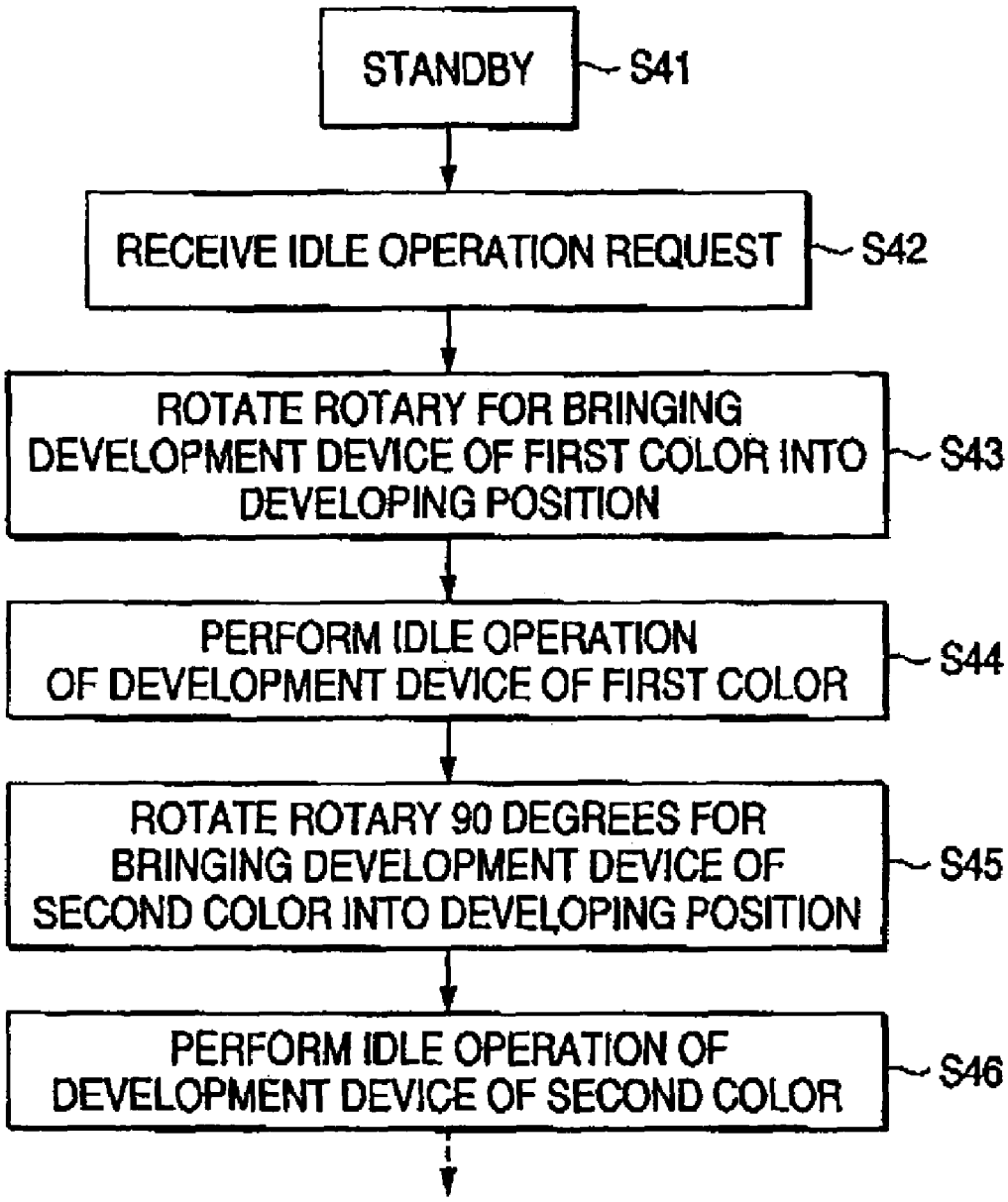
FIG. 9 is a flowchart to describe an idle operation flow in the rotary developing device.

FIG. 9 is a flowchart to describe an operation processing flow when the development roller is idled.

In the rotary developing device in the embodiment, one drive gear is included and rotation of the rotary and rotation of the development roller are switched. Thus, to rotate the development roller, it needs to be brought into the developing position. The rotary is at the home position in the standby state at step S41. Here, if an idle operation request (for example, a predetermined time has elapsed since the previous idling) comes (step S42), the rotary is rotated for bringing the development device of the first color into the developing position (step S43). Then, the idling operation is performed for the development device of the first color at the developing position (step S44). Next, the rotary is rotated 90 degrees for bringing the development device of the second color into the developing position (step S45), and the idling operation of the development device of the second color is performed (step S46). The described operation is repeated to the development devices of the fourth color. As such idle operation is performed, standing banding can be suppressed. An operation step of rotating only the rotary to agitate toner may be inserted following step S42.

In the example of the idle operation for the rotary developing device, the idle operation in the standby state has been described, but the idle operation may be performed after the predetermined time has elapsed since the preceding print operation after power on or when installation of a new development device is detected, as previously described with reference to FIGS. 2 to 4, of course, and the required time for the idle operation may be determined by the method previously described with reference to FIGS. 5 to 7.

As described above, according to the invention, the idle operation of the development roller is performed, whereby density unevenness caused depending on the standing state of the developing chamber portion and the exposure portion can be suppressed.

As described above, according to the invention, toner with the volume fraction of fine powder having particle diameter 5 μor less being set to 10% or less is used and further the existence ratio of free external additive is set to 8% or less as the number ratio and further the wax content is set to 4 wt % or less, whereby density unevenness caused depending on the standing state of the development roller can be suppressed.

What is claimed is:

1. An image formation apparatus comprising:

a development unit using a developer support having a conductive surface layer; and a control unit for causing an idle operation of the developer support to be performed at a predetermined timing in a non-print state;

wherein the idle operation is a rotation operation of the developer support when a developing bias applied to the developer support is off.

2. An image formation apparatus comprising:

a development unit using a developer support having a conductive surface layer; and a control unit for causing an idle operation of the developer support to be performed at a predetermined timing in a non-print state;

wherein the idle operation is a rotation operation of the developer support when an image exposure to an image support is off.

3. The image formation apparatus as claimed in claim 1 or claim 2, wherein the predetermined timing is involved in a non-operating time after power on or in a non-operating time after a termination of a preceding print.

4. The image formation apparatus as claimed in claim 1 or claim 2, wherein the predetermined timing is applied when installation of a new development device is detected.

5. The image formation apparatus as claimed in claim 3, wherein the idle operation performed in the non-operating time after the termination of the preceding print is performed for a time period determined based on a temperature, a humidity, and a toner consumption amount and an elapsed time since the preceding print.

6. The image formation apparatus as claimed in claim 3, wherein the idle operation performed in the non-operating time after power on or when installation of a new development device is detected is performed for the time period corresponding to a case of a high temperature, a high humidity, and a large elapsed time in the idle operation performed in the non-operating time after the termination of the preceding print.

7. The image formation apparatus as claimed in claim 4, wherein the idle operation performed in the non-operating time after power on or when installation of the new development device is detected is performed for a time period corresponding to a case of a high temperature, a high humidity, and a large elapsed time in the idle operation performed in the non-operating time after the termination of the preceding print.

8. An image formation apparatus comprising:

a development unit using a developer support having a conductive surface layer; and a control unit for causing an idle operation of the developer support to be performed before image formation operation;

wherein the idle operation is a rotation operation of the developer support when a developing bias applied to the developer support is off.

9. An image formation apparatus comprising:

a development unit using a developer support having a conductive surface layer; and a control unit for causing an idle operation of the developer support to be performed before image formation operation;

wherein the idle operation is a rotation operation of the developer support when an image exposure to an image support is off.

10. An image formation apparatus comprising:

a rotary developing unit; and a control unit for causing an idle operation of a developer support to be performed each time development units installed in said rotary developing unit are switched;

wherein the idle operation is a rotation operation of the developer support when a developing bias applied to the developer support is off.

11. An image formation apparatus comprising:

a rotary developing unit; and a control unit for causing an idle operation of a developer support to be performed each time development units installed in said rotary developing unit are switched;

wherein the idle operation is a rotation operation of the developer support when an image exposure to an image support is off.

12. An image formation method comprising the steps of:

performing an idle operation of a developer support to decrease a density unevenness caused depending on a standing state of a developing chamber portion and an exposure portion of the developer support; and opposing the developer support having the developing chamber portion and the exposure portion to an image support and forming an image;

wherein the idle operation is a rotation operation of the developer support when a developing bias applied to the developer support is off.

13. An image formation method comprising the steps of:

performing an idle operation of a developer support to decrease a density unevenness caused depending on a standing state of a developing chamber portion and an exposure portion of the developer support; and opposing the developer support having the developing chamber portion and the exposure portion to an image support and forming an image;

wherein the idle operation is a rotation operation of the developer support when the image exposure to an image support is off.

14. The image formation method as claimed in claim 12 or claim 13, wherein the idle operation is performed in a non-operating time after power on or in a non-operating time after a termination of a preceding print.

15. The image formation method as claimed in claim 14, wherein the idle operation performed in the non-operating time after power on or when installation of a new development device is detected is performed for a time period corresponding to a case of a high temperature, a high humidity, and a large elapsed time in the idle operation performed in the non-operating time after the termination of the preceding print.

16. The image formation method as claimed in claim 14, wherein the idle operation performed in the non-operating time after power on or when installation of the new development device is detected is performed for a time period corresponding to a case of a high temperature, a high humidity, and a large elapsed time in the idle operation performed in the non-operating time after a termination of a preceding print.

17. The image formation method as claimed in claim 12 or claim 13, wherein the idle operation is performed when installation of a new development device is detected.

18. The image formation method as claimed in claim 14, wherein the idle operation performed in the non-operating time after the termination of the preceding print is performed for a time period determined based on a temperature, a humidity, and a toner consumption amount and an elapsed time since the preceding print.

* * * * *